United States Patent [19]

Labbe et al.

[11] Patent Number: 4,793,364

[45] Date of Patent: Dec. 27, 1988

[54] CIGARETTE MANUFACTURE

[75] Inventors: Francis A. M. Labbe, Neuilly-sur-Seine, France; John R. Nowers, London, England; Paul R. Wiese, London, England; Ivan Y. Hirsh, London, England; Godfrey A. Wood, High Wycombe, England

[73] Assignee: Molins PLC, London, England

[21] Appl. No.: 827,604

[22] Filed: Feb. 10, 1986

[30] Foreign Application Priority Data

Feb. 9, 1985 [GB] United Kingdom ..... 8503371
May 3, 1985 [GB] United Kingdom ..... 8511406

[51] Int. Cl.[4] ..... A24C 5/14
[52] U.S. Cl. ..... 131/84.3
[58] Field of Search ..... 131/84.3, 84.4, 108, 131/109.1, 110

[56] References Cited

U.S. PATENT DOCUMENTS 3,795,249 3/1974 Cristiani ..... 131/84.3
3,854,486 12/1974 Molins et al. ..... 131/84.3
3,987,804 10/1976 Molins et al. ..... 131/84.3
3,999,559 12/1976 Marritt et al. ..... 131/84.3
4,069,829 1/1978 Molins et al. ..... 131/84.3
4,516,585 5/1985 Pinkham ..... 131/84.3

*Primary Examiner*—V. Millin
*Attorney, Agent, or Firm*—Antonelli, Terry & Wands

[57] ABSTRACT

A cigarette making machine has an arrangement for showering tobacco A (a high-taste tobacco) on to a first conveyor carrying outward projections defining the ends of portions of tobacco A which are then transferred at spaced intervals to a second conveyor arranged thereafter to receive a layer of tobacco B (a low-tar tobacco or substitute) filling the spaces between the portions of tobacco A and extending over those portions. The machine includes a trimming device for removing excess tobacco B to form a cigarette filler stream ready for enclosing in a paper wrapper to form a continuous rod. This allows the manufacture of "light" cigarettes of which the first few puffs have an enhanced taste as a result of the tobacco A at the lit end.

10 Claims, 4 Drawing Sheets

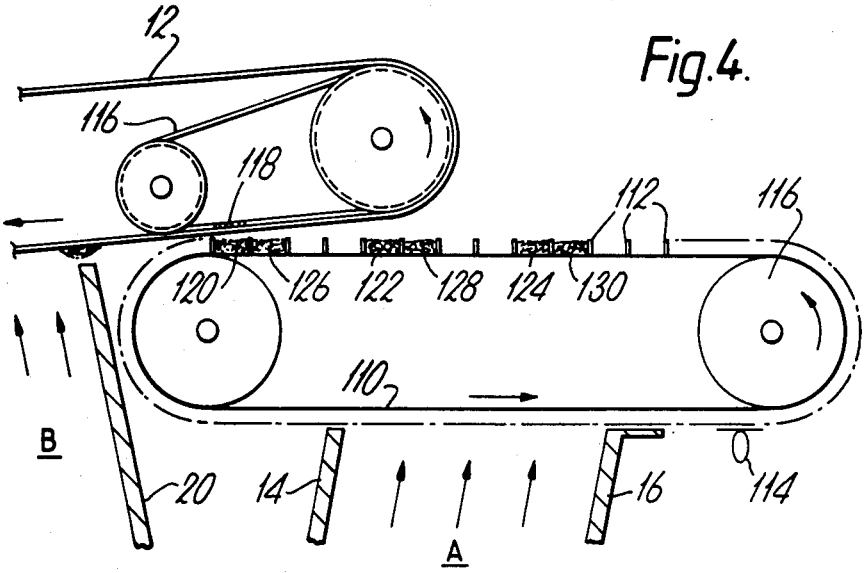
Fig.4.
Fig.5.
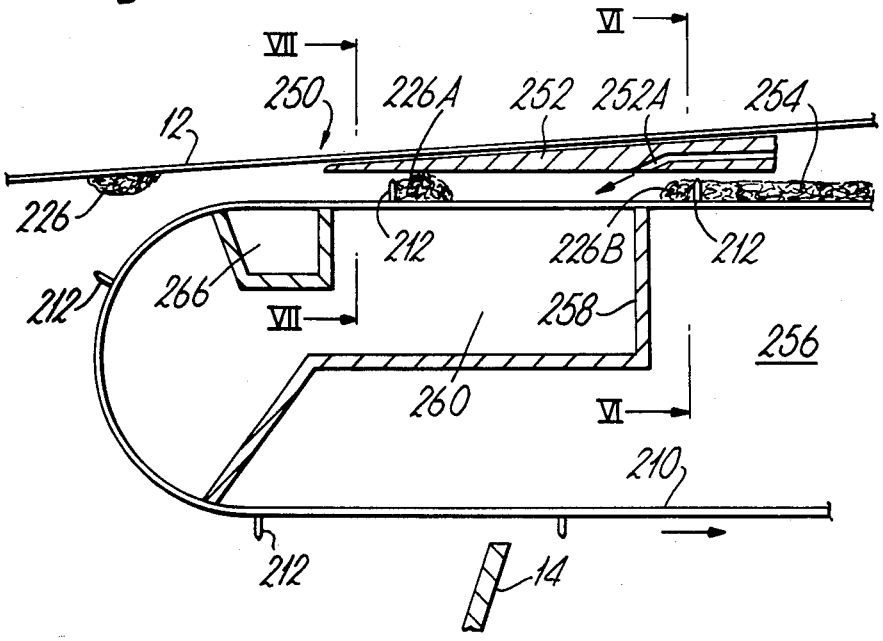

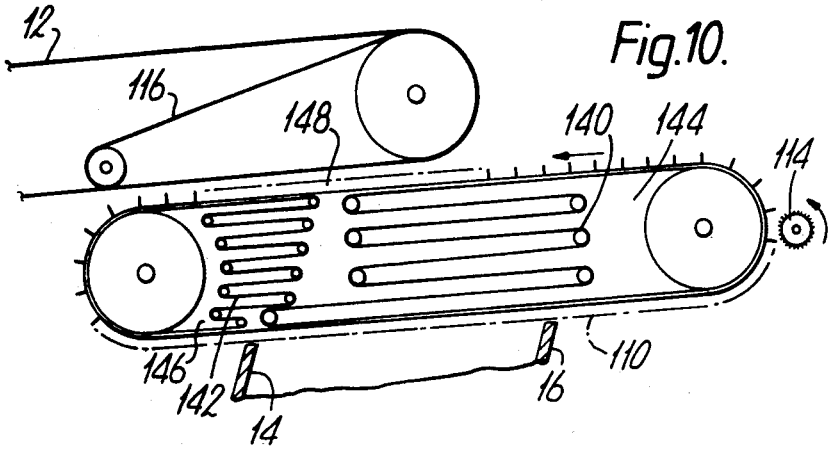
Fig.10.
Fig.11.
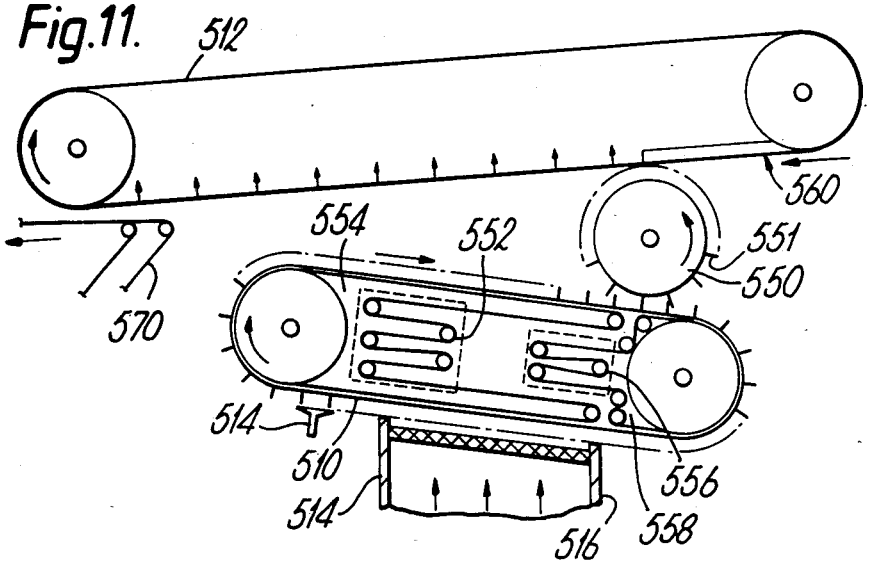
Fig.12.
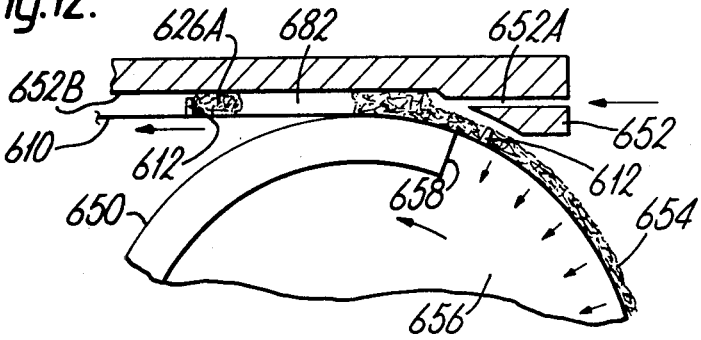

CIGARETTE MANUFACTURE

This invention is concerned with the manufactured of cigarettes having a filler formed by two different tobaccos or tobacco blends of which one (referred to as "tobacco A") forms the major proportion of tobacco at the lit end of the cigarette, the other end of the cigarette being filled mainly or entirely by the second tobacco or tobacco blend ("tobacco B"). Examples of such cigarettes and of machines for making them are described in British patent specifications Nos. 1382266 and 2124471.

In this context the term "tobacco" is intended to include generally all materials, including tobacco substitutes, suitable for use in cigarettes. For example, the tobacco B in particular may comprise or include tobacco substitute material, the tobacco A being possibly a high-flavour tabacco.

According to this invention, a cigarette making machine comprises means for feeding tobacco A (especially by showering) onto a first conveyor carrying outward projections defining the ends of portions of tobacco A which are then transferred to a second conveyor arranged thereafter to receive a layer of tobacco B filling the spaces between the portions of tobacco A and preferably also extending over those portions, and the machine includes a trimming device for removing excess tobacco B to form a cigarette filler stream ready for enclosing in a paper wrapper to form a continuous cigarette rod.

In one machine according to this invention, the projections on the first conveyor comprise lugs extending for a significant distance along the first conveyor in the direction of movement thereof so as to occupy space which would otherwise receive tobacco A. Between the lugs, the first conveyor is air-pervious to enable suction to hold tobacco A arriving in the spaces between the lugs. Excess tobacco may be trimmed away by an air jet directed across the conveyor, at approximately the level of the outer surfaces of the lugs, so as to remove any tobacco projecting beyond the lugs. The first conveyor is preferably a band. In order partly to avoid stiffening the band excessively, the lugs may be relatively short (in the direction of movement of the conveyor), and portions of tabacco A accumulating between alternate lugs or, for example, in the second and third spaces between successive lugs, are removed pneumatically and/or by centrifugal force. The use of relatively short lugs also ensures that a substantial proportion of the tobacco showered toward the band is gripped and carried forward positively by the band as a result of the suction applied through the band.

Certain parts of the machine described above are similar to the machine described in our British patent specification No. 1416019. Reference is directed to that specification in its entirety. Compared with that specification, which may be regarded as forming an annulus of tobacco A around a core of tobacco B, the present invention is simpler and allows cigarettes to be made with a larger proportion of tobacco B. Compared with British specification No. 1382266, the present invention reduces the amount of recirculation of tobacco A, which is important if the tobacco A is the higher quality and more expensive tobacco.

The following alternative forms of machine according to this invention reduce still further the recirculation of tobacco A.

A machine according to a second aspect of this invention comprises a first conveyor carrying projections at regular intervals (for example in the form of ribs or rows of pins), means for feeding tobacco A onto the first conveyor to form a substantially continuous layer of tobacco separated into discrete portions by the projections, and a second conveyor arranged to pick up spaced portions of tobacco A, without picking up intervening portions of tobacco A, and including means for feeding a layer of tobacco B at least between the portions of tobacco A on the second conveyor.

The second conveyor may comprise a suction conveyor, like that used in the Molins Mark 8 cigarette making machine, with the addition of a masking band which lies within and moves with the suction conveyor and has apertures at spaced areas through which suction is applied to pick up selected portions of tobacco A from the first conveyor.

If it is desired to trim the layer of tobacco A on the first conveyor then the tobacco removed by the trimming operation constitutes the only recirculation of tobacco A. Trimming may be achieved by a double disc arrangement generally similar to that described in British application No. 958208 or may be achieved in some other way, for example by means by an air jet. This trimming operation is not particularly critical since the weight of each cigarette is determined by the final trimming operation carried out upon the combined stream of tobaccos A and B, preferably to remove only a continuous excess of tobacco B.

A machine according to a third aspect of this invention comprises a first conveyor having projections (preferably in the form of lateral rows of pins) at intervals corresponding to the desired intervals between portions of tobacco A. A continuous layer of tobacco A is formed on the first conveyor and is preferably trimmed. In the region of a transfer area between the first conveyor and a second conveyor, means are provided for blowing each portion of tobacco A lying between successive projections towards the projection lying at one end (preferably the leading end) of that portion to accumulate tobacco in the area of that projection immediately before transfer of that portion of tobacco A to the second conveyor. In the region where the tobacco A in the preferred arrangement is blown forwards, the tobacco is preferably confined between stationary walls which diverge in the direction of movement of the first conveyor. For example, if the completed cigarette filler stream has dimensions of approximately 10 mm×10 mm, the width and height of the layer of tobacco A formed on the first conveyor may for example be respectively 6 mm and 5 to 6 mm. In the region where tobacco A is blown forward, the channel through which it is blown is preferably defined by the first conveyor itself, two stationary side walls, and a stationary wall opposite to the first conveyor. The latter wall may be substantially parallel to the first conveyor and is preferably coated with or formed from a very low-friction material such as ultra-high-molecular-weight-polyethylene (abbreviated herein to UHMWP).

Examples of machines according to this invention are shown in the accompanying drawings. In these drawings:

FIG. 4 is a diagrammatic front view of part of a second machine;

FIG. 5 is a diagrammatic front view of a smaller part of a third machine;

FIGS. 10 to 12 are diagrammatic views of parts of three further machines.

Figure 1:
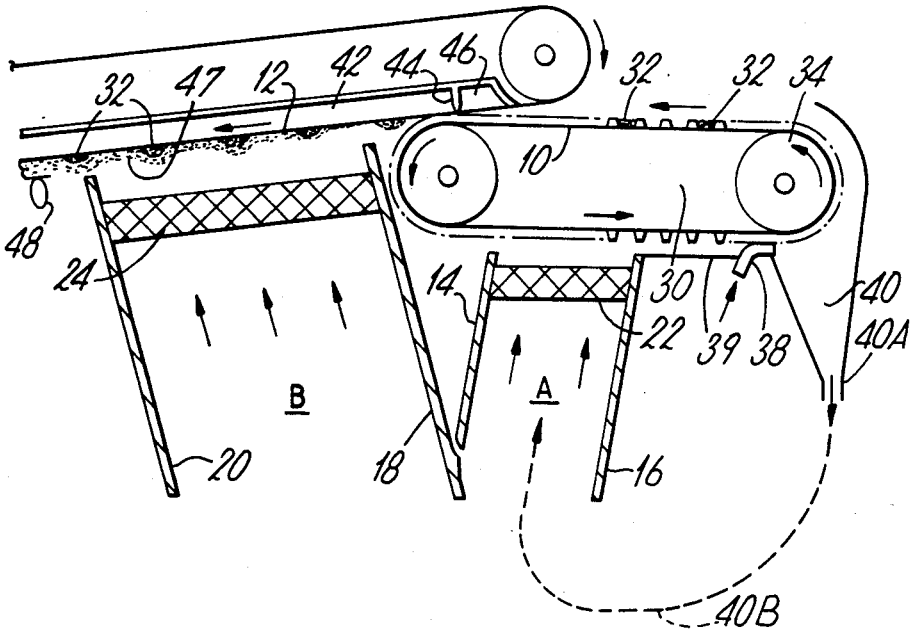
FIG. 1 is a diagrammatic front view of one machine.

The machine shown in FIG. 1 is based upon the Molins Mark 8 and is similar in certain respects to the machine described in our British patent specification No. 1416019. In particular, two different types of tobacco A and B are showered towards first and second conveyors 10 and 12 respectively through chimneys formed by walls 14, 16 and 18, 20. Supercharger louvres 22 and 24 are provided near the upper ends of the respective chimneys to promote upward movement of the tobacco towards respective conveyors 10 and 12. The feed of tobacco into the two chimneys may be as described in specification No. 1416019.

Figure 2:
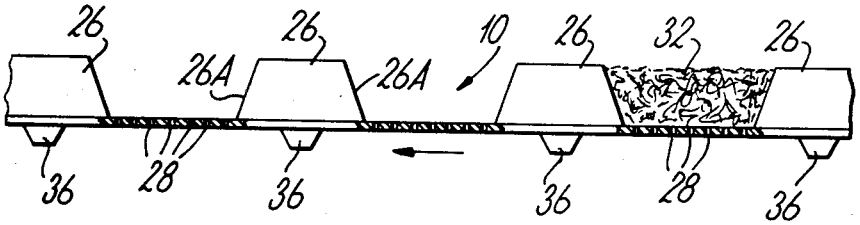
FIG. 2 is an enlarged view of part of the first conveyor in the machine shown in FIG. 1.

As shown most clearly in FIG. 2, the conveyor 10 comprises a band carrying projections in the form of lugs 26 at regular intervals along the band. In the areas between the lugs, the band has perforations 28 through which suction is applied from a suction chamber 30 to hold tobacco on the band where necessary. It should be noted that the flanks 26A of the lugs are inclined. This helps in regard to the transfer of portions 32 of tobacco A from the band 10 to the second conveyor 12; moreover, although the portions 32 collapse to some extent (see FIG. 3) while being carried by the conveyor 12, they are relatively stable at their ends as delivered by the conveyor 10.

In order to maintain a fixed timing between the band 10 and a driving pulley 34 for the band, the band has inward projections in the form of teeth 36. Each lug 26 and its corresponding tooth 36 may be moulded integrally from a plastics material. The band itself may be of plastics material with longitudinal reinforcement.

Tobacco A showered up the chimney 14, 16 collects in the spaces between all the lugs 26 and is initially held on the conveyor 10 by suction. Excess tobacco protuding beyond the outer surfaces of the lugs 26 is removed by an air jet directed across (or obliquely across) the conveyor 10 from a pipe 38 which also removes any tobacco tending to cling to the outer surfaces of the lugs 36. This excess tobacco is directed by the air jet into a chamber 40 from which it is continuously drawn through an outlet 40A from which it may be delivered directly back into the chimney 14, 16 as shown by the dotted flow path 40B in FIG. 1.

The arrangement may be such that any tobacco which is not gripped and positively moved forward by the band 10 is carried towards the chamber 40 by a flow of air through an enclosure 39. This enclosure may be in accordance with the invention described in our British patent specification No. 2023401.

FIG. 2 shows the upper run of the conveyor 10 after two out of every three portions of tobacco A have been removed. For the purpose of this example, it is assumed that the portions 32 required to be delivered to the second conveyor 12 are at the intervals shown in FIG. 2. For this purpose, the pulley 34 has circumferentially spaced ports at its periphery to which suction is applied only where tobacco is to be retained. In the intervening areas the interior of the pulley may be at atmospheric or above-atmostpheric pressure to remove the tobacco in those areas with the aid of centrifugal force, such tobacco being thrown into the chamber 40 from which it is extracted through the outlet 40A.

The portions 32 of tobacco A remaining on the conveyor 10 are held by suction until they reach the conveyor 12. Suction is applied through the conveyor 12 from an internal suction chamber 42 commencing at a wall 44. Immediately upstream of the wall 44 there is a space 46 which may be at atmospheric or above-atmospheric pressure to ensure that the portions of tobacco 32 on the conveyor 10 are not disturbed until they reach the transfer point immediately downstream of the wall 44.

Tobacco B showered upwards through the chimney 18, 20 forms a layer 47 which fills the spaces between the portions 32 and covers those portions, as shown in FIG. 1. A trimmer 48 removes excess tobacco B to form a filler stream (shown in FIG. 3) ready to be enclosed in a paper wrapper to form a continuous rod in the well-known manner.

Figure 3:
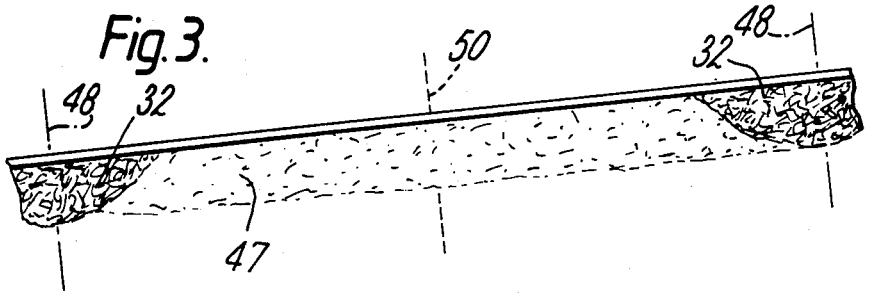
FIG. 3 is a view, to the same scale as FIG. 2, of the second conveyor, showing both types of tobacco.

FIG. 3 shows the filler stream trimmed to a uniform height. As an alternative, "dense end discs" may be used in the trimmer so as to leave additional amounts of tobacco B (overlying the portions 32); an example of such a trimmer is described in our British patent specification No. 958208.

With reference to FIG. 3, the wrapped cigarette rod will be cut at positions 48 corresponding to the centres of the portions 32 of tobacco A, and also at intermediate positions 50. It will be understood that the lit ends of the cigarettes (remote from the filters in the case of filter cigarettes) lie at positions 48 and therefore include a substantial proportion of tobacco A. At the intermediate positions 50 (corresponding to the filter ends of the cigarette) there is substantially no tobacco A.

In principle it would be possible to avoid the need to remove entire portions of tobacco in the region of the pulley 34 by the use of longer studs. However, that would tend to create a problem at the upper end of the chimney 14, 16 in that a substantial proportion of the tobacco arriving at that end of the chimney would not immediately be picked up by the conveyor 10. Furthermore, the use of longer studs would generally stiffen the conveyor 10.

Instead of there being two empty spaces between successive portions 32 of tobacco as shown in FIG. 2, they could be just one or possibly more than two, depending upon the relationship between the desired stud length and the length of the finished cigarettes.

The shape and/or dimensions of the studs may be altered to change the amount of tobacco A forming each portion delivered by the conveyor 10. For example, the flanks 26A of the studs 26 may in plan view be concave or convex.

Excess tobacco delivered from the outlet 40A, being already winnowed and well loosened, is preferably fed directly into the chimney 14, 15 (in the left-hand region thereof as shown), rather than back into the hopper. If that is done then the part of the hopper which feeds tobacco A may be arranged normally to feed tobacco A only into the right-hand part of the chimney. However, it is desirable to make some provision for an increased feed from the tobacco A hopper while the machine is being started as there would otherwise not be sufficient tobacco A flowing up the chimney 14, 16 to form the excess in the first place. This may be achieved by providing, in the tobacco A hopper, a movable wall (e.g. pivoted) which allows tobacco to be fed initially from the tobacco A hopper across the entire width of the chimney 14, 16 while the machine is being started, and then gradually moves to a position in which it restricts the width of the tobacco A fed from the hopper in the required manner. Alternatively, while the machine is being started, an additional air jet may be arranged to blow all the tobacco A off the conveyor 10 and into the chamber 40 until the delivery from the outlet 40A is sufficient for normal running.

The following modification of the machine showing FIG. 1 may be made. Instead of the excess tobacco A being removed in the vicinity of the pulley 34, it may be continuously blown sideways off the conveyor 10 by moving air jets formed in the manner described in our U.S. Pat. No. 3,854,486. In that case, or in any event, it may be possible to omit the pneumatic or other trimmer 38 provided the feed rate of tobacco into the chimney 14, 16 is reasonably well controlled.

FIG. 4 shows a second machine which is similar to that shown in FIG. 1 in that tobacco B is showered upwards as before onto suction conveyor 12 after the latter has received spaced portions of tobacco A. However, the first conveyor 110 in this example receives a substantially continuous layer of tobacco A divided into individual portions by projections 112 which may be in the form of blades moulded or otherwise formed or mounted on the conveyor. Alternatively, each projection may comprise a row of pins.

The substantially continuous layer of tobacco A formed on the lower run of the conveyor 110 is trimmed by a trimming device 114 and is then held on the conveyor by suction while it passes around a pulley 116. However, in this instance the feed of tobacco through the chimney 14, 16 is intermittent for the reason described below.

Within the suction conveyor 12 there is a masking band 116 which is driven at the same speed as the conveyors 12 and 110. This band is formed with regularly spaced groups of perforations 118, only one such group being shown in FIG. 4. Elsewhere the masking band 116 is impervious so to prevent the application of suction through the conveyor 12.

FIG. 4 shows the machine at a moment of time when there are portions 120, 122, 124 etc, of tobacco A which are about to be transferred successively to the conveyor 12 by means of suction applied through successive groups of perforations in the masking band. Those portions of tobacco A are followed respectively by portions 126, 128 and 130 which will be transferred to the conveyor 12 during the next revolution of the conveyor 110. Immediately following each of the portions 126, 128 and 130 there are two empty spaces from which the tobacco was transferred during two previous revolutions of the conveyors 110.

In order for different portions of tobacco on the conveyor 110 to be transferred during successive revolutions of the conveyor 110, it is necessary for the conveyor 110 to have a length such that it can accommodate, for example, $4N+1$ or $4N-1$ regularly spaced projections 112, where N is an integral number. It will be understood that the arrangement shown in which every fourth portion of tobacco 122 is transferred from conveyor 110 is only an example. If a larger proportion of tobacco A is required in each cigarette, the projections 112 would be at larger intervals and every third portion would be transferred for example. Alternatively, if less tobacco A is needed then every fifth or sixth portion may be transferred. The length of the conveyor 110 in those examples would be such as to accommodate $3N+1$ or $3N-1$ projections, or $5N+1$ or $5N-1$ and so on.

Since the conveyor 110 carries some of the tobacco portions through a number of revolutions before depositing them on the conveyor 12, it is necessary for the feed of tobacco into the chimney 14, 16 to be intermittent. For example, for the specific arrangement shown in FIG. 4 the hopper would be required to deliver tobacco during spaced periods of time (P) corresponding approximately to the time taken for one complete revolution of the conveyor 110. Between such periods of tobacco delivery, the hopper would be required not to deliver tobacco for periods equal to approximately 3P. For that purpose, if delivery of tobacco is by means of a carded drum (e.g. like the drum 1 shown in FIG. 1 of our British patent specification No. 909222) then relatively small segments of the drum will be provided with pins, and intervening larger segments would be free of pins. Accordingly, for this purpose the carded drum would need to rotate at a speed which is an integral fraction of the speed of rotation of the conveyor 110.

The timing of delivery of tobacco by the carded drum into the chimney 14, 16 is not critical. It is necessary to ensure that tobacco is always delivered when it is required, but a slight excess can be tolerated since it merely results in additional tobacco being removed by the trimming device 114.

FIG. 5 shows part of a third machine which includes conveyors and chimneys as shown in FIG. 4. In this example a first conveyor 210 which receives tobacco A is similar to the conveyor 110 in FIG. 4, expect that it has transversely extending rows of pins 212 lying at larger intervals corresponding to the required intervals between successive portions of tobacco 226 delivered to the conveyor 12. A continuous layer of tobacco A is formed on the conveyor 210 and is trimmed (if required) in the same way as in FIG. 4.

Mounds of tobacco are delivered from the conveyor 210 to the conveyor 12 approximately at a transfer station 250. FIG. 5 shows the area of the machine generally in the approach to that transfer station. Above the conveyor 210, in the region of the approach to the transfer station 250, there is a stationary top wall 252. The sides of the tobacco stream 254 on the conveyor 210 are confined, upstream of this region, by parallel rails (not shown) spaced apart, for example, by 6 mm. Thus the trimmed stream of tobacco A has smaller cross-sectional dimensions (e.g., 6 mm×5 mm) than the completed cigarette filler stream. The tobacco A is held on the conveyor 210 (which is perforated for that purpose) by suction applied from a suction chamber 256. Suction ceases as the conveyor moves over a wall 258 forming one end of a chamber 260 which is at atmospheric or slightly above-atmospheric pressure. At the same time as suction ceases, an air jet delivered from a passage 252A in the wall 252 blows the tobacco forwards. Being free to move in the absence of suction applied to the conveyor 210, the tobacco moves forward so as to pile up behind the immediately preceeding row of pins 212. FIG. 5 shows such a pile-up of tobacco 226A and shows further tobacco 226B which will shortly be blown forward after passing the wall 258. As a result, spaced mounds of tobacco 226 are formed on the conveyor 210 and are transferred to the conveyor 12 at the transfer setation 250 which is immediately downstream of the left-hand end of the top wall 252.

To assist the transfer of tobacco to the conveyor 12 there may be a chamber 266 below the transfer point 250 which is supplied with air at slightly above atmospheric pressure.

Figure 6:
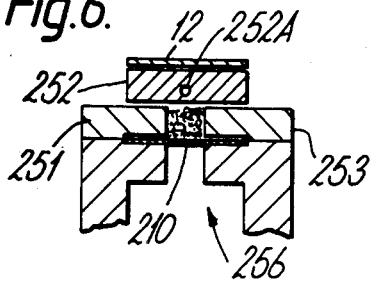
FIGS. 6 and 7 are sections on the lines VI—VI and VII—VII in FIG. 5.
Figure 7:
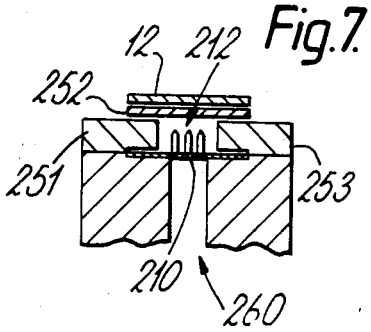

In the region where tobacco A is blown forward by the air jet, stationary side walls 251 and 253 (FIGS. 6 and 7) diverge, e.g. from a spacing of 6 mm to 10 mm, so as to form mounds 226 of tobacco corresponding in width to the complete tobacco stream which will be formed on the conveyor 12.

The surfaces of the side walls 251, 253 and top wall 252 are preferably coated with UHMWP. Alternatively, those parts may be made entirely of that material.

The lower surface of the top wall 252 may diverge from the conveyor 210 in the direction of movement of the conveyor to allow the completed mount of tobacco to be higher than the initial layer 254.

Instead of tobacco B being fed onto the conveyor 12 (in any of the examples) by showering through a chimney, spaced sections of tobacco B may be formed by a second intermediate conveyor arrangement, like that shown in FIG. 4 or FIG. 5, for subsequent delivery to the conveyor 12 between the mounds of tobacco A.

Figure 8:
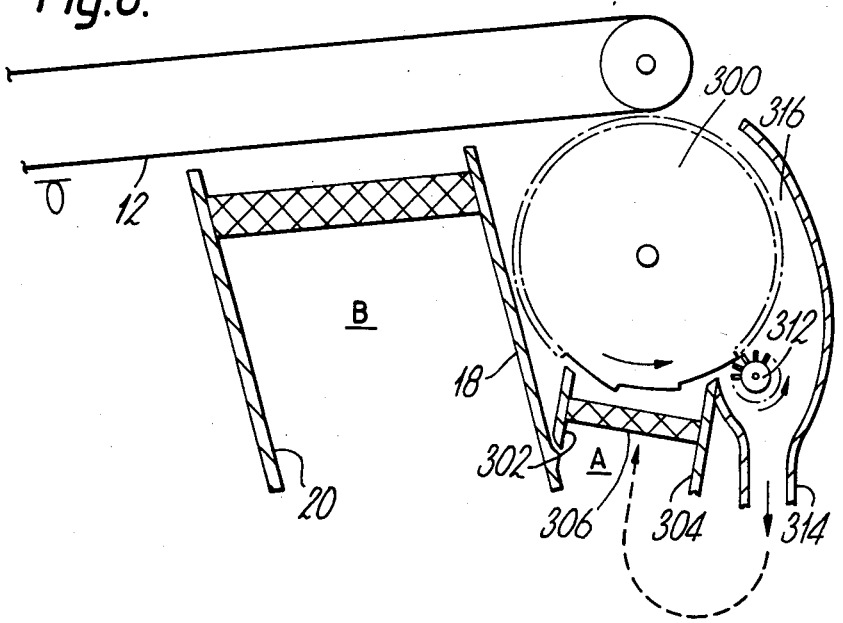
FIG. 8 is a diagrammatic front view of part of a fourth machine including a wheel.

In each of the examples described above, the first conveyor 10, 110 or 210 may be replaced by a larege wheel, for example one dimensioned and positioned as shown in FIG. 8.

In the examples show in FIGS. 4 and 5, the conveyors 110 and 210 may be of longitudinally reinforced plastic with integral moulded projections. They may also include internal timing teeth, as in FIG. 1.

The apparatus shown in FIG. 4 may be used for other purposes in which measured spaced portions of tobacco or other similar shredded material are required. For example, in the spaces between tobacco portions, tubes or portions of stiff card may be inserted to provide a finished product comprising a continuous wrapped rod containing alternating tube and tobacco portions; the continuous rod is then cut through the middle of the tubes and tobacco portions to produce individual Papirosi-type cigarettes. Alternatively the tubes may be replaced by filters.

Figure 9:
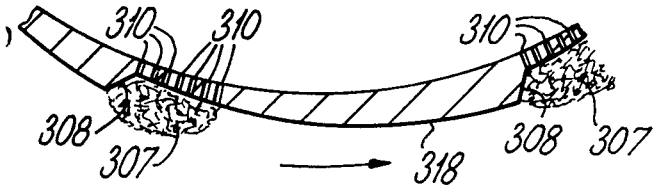
FIG. 9 shows part of the wheel in FIG. 8 on a larger scale.

FIG. 8 shows a machine which is similar to that shown in FIG. 1 in regard to the use of a conveyor 12 and a chimney 18, 20. In this example, however, the first conveyor is in the form of a wheel 300 which receives an upward shower of tobacco A through a chimney 302, 304, possibly with the aid of a supercharger louvre 306. As shown particularly in FIG. 9, portions 307 of tobacco A form on the wheel immediately upstream of projections 308 where the tobacco is gripped by suction applied through perforations 310. A trimming device 312 (FIG. 8) removes excess tobacco which, together with any tobacco A not held by the wheel, is returned through an outlet 314 of a chamber 316.

Where there are no perforations 310 to grip the tobacco by suction, the periphery of the wheel is smooth to allow tobacco to slide towards the next-following projection 308. In the example shown, the smooth surfaces 318 slope inwards. They may alternatively be at a constant radius with respect to the axis of the wheel, the projections 308 then being rib-like as in FIG. 4.

The wheel may have integral side flanges for confining the sides of the tobacco portions. Alternatively, the wheel may run between fixed side walls engaging and confining the tobacco portions.

FIG. 8 shows a trimming device in the form of a pinned roller rotating anti-clockwise as shown, or alternatively clockwise. Alternatively, the roller may be replaced by a conventional double-disc trimmer or by one or more air jets which may be directed rearwardly in relation to the direction of movement of the tobacco portions.

The features described above in connection with the wheel may alternatively be applied to a first conveyor in the form of a band generally as shown in FIG. 1.

FIG. 10 shows a machine which is a modified form of that shown in FIG. 4. Parts which are similar or equivalent to those in FIG. 4 are identified by the same reference numerals.

The main difference in FIG. 10 is that the first conveyor 110 includes two masking tapes 140 and 142 respectively to prevent excessive leakage of suction to atmosphere through the conveyor 110 in regions where it is not carrying tobacco. Each type, which may be of plastic material (e.g. UHMWP), has air-previous and non-pervious portions to control or cut off the transmission of suction, as required, from suction chambers 144 and 146 respectively. Each masking tape has a length K times the length of the conveyor 110, where K is the number of times the length of completed cigarette rods is greater than the length of the portions of tobacco A delivered by the conveyor 110 (e.g. four in the example shown in FIG. 4). Portions of tobacco A are transferred from the conveyor 110 to the conveyor 12 at the point 148 between adjacent ends of the two masking tapes 140 and 142.

The masking tapes may have notched edges whereby they are driven at the same speed and with appropriate timing in relation to the conveyor 110.

FIG. 11 shows diagrammatically a machine for making Papirosi cigarettes, as mentioned above. The machine is similar to that shown in FIG. 4, as indicated by the use of similar reference numerals (increased by 400) for similar or equivalent parts.

In FIG. 11 there is only one chimney 514, 516 through which tobacco is showered onto a first conveyor 510. Across the top of the chimney, the conveyor moves to the left, in contrast with FIG. 4, since the tobacco portions are transferred to the conveyor 512 via a wheel 550. A masking tape 552 in this case controls the transmission of suction from a suction space 554, while a masking tape 556 controls the transmission of suction from a space 558. The tapes have spaced perforated areas for transmitting suction where necessary. The factor K in this case may, for example, be 2.

The wheel 550 has projections 551 at the same intervals as the projections on the conveyor 510 to hold in place the ends of the tobacco portions.

Pre-formed tubes are fed onto the conveyor 512 at 560, in a manner not shown, to occupy the spaces between successive tobacco portions. Subsequently a paper web 570 is wrapped around the tubes and tobacco portions to form a continuous rod which, when cut through the middle of each tube and each tobacco portion, produces the desired Papirosi cigarettes.

The tubes delivered to the conveyor 512 may comprise rolled portions of cardboard secured by hot-melt adhesive with a relatively low melting point. The purpose of the low melting point is to enable the adhesive to be softened by heat while the tobacco and tubes are passing through the garniture, thus allowing the tobacco portions to be slightly over compressed in the usual way, after which the tubes can expand slightly back to their original diameter which corresponds to the diameter of the finished cigarettes. For this purpose, the tube making machine should be closely associated with the cigarette making machine to ensure that the adhesive-bonded seams lie precisely along the tops of the tubes.

FIG. 12 shows part of a modified form of the machine shown in FIG. 5. Instead of the forward blowing of tobacco taking place immediately before the transfer point, it occurs in FIG. 12 in the region where the conveyor 610 is leaving the pulley 650 (equivalent to the pulley 116 in FIG. 4). This enables the air jet to be directed axially in line with the channel 682 through which the tobacco is blown, the air jet being admitted from a passage 652A in a fixed member 652. A suction chamber 656 whereby tobacco 654 is held on the conveyor as it passes around the pulley 650 terminates at a wall 658 which is approximately 20 degrees upstream of top dead centre.

A horizontal underneath surface 652B of the member 652 is spaced from the horizontal run of the conveyor 612 by a distance greater than the radial thickness of the tobacco as it passes around the pulley 650. Also, as in the example described in FIG. 5, the side walls confining the tobacco stream in the region where it is blown forward by the air jet may diverge as described above.

Separation of the tobacco from the conveyor 610 as it starts to move forward under the influence of the air jet is assisted by centrifugal force since the air jet impinges on the tobacco before it leaves its curved path around the pulley 650.

The air pressure may be adjustable.

Instead of each mound 226A or 626A of tobacco being arranged to collect at the adjacent downstream projection 212 or 612, as shown in FIGS. 4 and 12, it may be arranged to collect at the adjacent upstream projection. For example, this may be achieved by releasing the suction as the tobacco passes around the pulley 650, while keeping the tobacco close to the pulley by means of a curved fixed shroud. The gap between the shroud and the pulley may increase in the direction of movement of the conveyor to allow the radial dimension of the tobacco to increase as the tobacco piles up adjacent to the immediately following projection. Also, as in the previous examples, side walls confining the tobacco may diverge in the direction of movement of the tobacco. Such an arrangement may be thought of in terms of backwards collation, as opposed to the forward collation of FIGS. 4 and 12.

In all the above examples the distance between successive mounds of tobacco A on the second conveyor may be adjusted to some extent by altering the speed of one conveyor relative to the other. For example, the speed of the first conveyor (with its associated masking tapes if appropriate) may be adjusted within predetermined limits upwards or downwards with respect to the speed of the second conveyor.

We claim:

1. A cigarette making machine comprising means for feeding tobacco A onto a first conveyor carrying outward projections defining the ends of spaced portions of tobacco A, the first conveyor being air-pervious in areas lying between the projections and including means for applying suction to the air-pervious areas to retain the required portions of tobacco A on the first conveyor; a second conveyor arranged to receive the portions of tobacco A from the first conveyor and thereafter to receive a layer of tobacco B filling spaces between the portions of tobacco A and also extending over those portions; and a trimming device for removing excess tobacco B to form a cigarette filler stream ready for enclosing in a paper wrapper to form a continuous cigarette rod; the first conveyor being in the form of a band which, after receiving the tobacco A, passes around a pulley at which excess tobacco A which is not retained by suction is arranged to fly off under the influence of centrifugal force.

2. A machine according to claim 1 in which the projections comprise lugs extending for a significant distance along the first conveyor in the direction of movement thereof, so as to occupy spaces which would otherwise receive tobacco A.

3. A cigarette making machine comprising means for feeding tobacco A onto a first conveyor carrying outward projections defining the ends of spaced portions of tobacco A, a second conveyor arranged to receive the portions of tobacco A from the first conveyor and thereafter to receive a layer of tobacco B filling the spaces between the portions of tobacco A and also extending over those portions, and a trimming device for removing excess tobacco B to form a cigarette filler stream ready for enclosing in a paper wrapper to form a continuous cigarette rod, the first conveyor being arranged to carry adjacent portions of tobacco A towards the second conveyor, and including a masking tape in the second conveyor having longitudinally spaced perforated areas for transmitting suction through the second tape at predetermined locations for transferring selected portions of tobacco A from the first conveyor to the second conveyor.

4. A machine according to claim 3 in which the selected tobacco portions transferred during each revolution of the first conveyor are spaced along the conveyor, portions at different positions on the first conveyor being transferred during successive revolutions of the first conveyor.

5. A machine according to claim 3 in which the first conveyor includes at least one masking tape for controlling the transmission of suction through the first conveyor.

6. A cigarette making machine comprising means for feeding tobacco A onto a first conveyor carrying outward projections defining the ends of spaced portions of tobacco A, a second conveyor arranged to receive the portions of tobacco A from the first conveyor and thereafter to receive a layer of tobacco B filling the spaces between the portions of tobacco A and also extending over those portions, and a trimming device for removing excess tobacco B to form a cigarette filler stream ready for enclosing in a paper wrapper to form a continuous cigarette rod, the machine being arranged to form a substantially continuous layer of tobacco A on the first conveyor and including means for gathering each portion of tobacco into a region adjacent to a corresponding downstream or upstream projection before transfer to the second conveyor.

7. A machine according to claim 6 in which the collating means comprises means for producing an air jet for blowing the tobacco of each portion towards the corresponding projection.

8. A machine according to claim 7 in which the first conveyor is a band passing around a number of pulleys and in which the air jet is arranged to blow each portion of tobacco forwrad which is still passing around a pulley.

9. A machine according to claim 6 in which each portion of tobacco A, while it is being collated, is confined at its sides by diverging stationary side walls whereby the width of each tobacco portion increases as it is being collated.

10. A cigarette making machine comprising means for feeding tobacco A onto a first conveyor carrying outward projections defining the ends of spaced portions of tobacco A which are then transferred to a second conveyor arranged to receive, in the spaces between the portions of tobacco A, items selected from the group consisting of tubes, filter, other mouthpiece devices and tobacco, and including means for transferring spaced portions of tobacco A from the first conveyor to the second conveyor, adjacent portions being transferred during different revolutions of the first conveyor.

* * * * *